United States Patent [19]

Clerc et al.

[11] Patent Number: 5,052,178

[45] Date of Patent: Oct. 1, 1991

[54] UNITARY HYBRID EXHAUST SYSTEM AND METHOD FOR REDUCING PARTICULATE EMMISSIONS FROM INTERNAL COMBUSTION ENGINES

[75] Inventors: James C. Clerc, Columbus, Ind.; John R. Gladden, Germantown Hills, Ill.; Paul R. Miller, Columbus, Ind.

[73] Assignee: Cummins Engine Company, Inc., Columbus, Ind.

[21] Appl. No.: 390,884

[22] Filed: Aug. 8, 1989

[51] Int. Cl.[5] ..... F01N 3/02

[52] U.S. Cl. ..... 60/274; 60/286; 60/288; 60/297; 55/283; 55/DIG. 30; 422/169

[58] Field of Search ..... 60/274, 286, 297, 288; 55/283, DIG. 30; 422/169

[56] References Cited

U.S. PATENT DOCUMENTS

| | | | |
|---|---|---|---|
| Re. 33,118 | 11/1989 | Scheitlin et al. . | |
| 4,345,431 | 8/1982 | Suzuki | 60/286 |
| 4,404,798 | 9/1983 | Takagi | 60/296 |
| 4,449,362 | 5/1984 | Frankenberg et al. . | |
| 4,485,621 | 12/1984 | Wong et al. . | |
| 4,510,749 | 4/1985 | Taguchi et al. . | |
| 4,677,823 | 7/1987 | Hardy . | |
| 4,686,827 | 8/1987 | Wade et al. . | |
| 4,961,314 | 10/1990 | Howe et al. . | |

FOREIGN PATENT DOCUMENTS

| | | | |
|---|---|---|---|
| 0020766 | 1/1981 | European Pat. Off. . | |
| 0318462 | 5/1989 | European Pat. Off. . | |
| 0356040 | 2/1990 | European Pat. Off. . | |
| 3328491 | 2/1985 | Fed. Rep. of Germany | 60/288 |
| 3842282 | 8/1989 | Fed. Rep. of Germany . | |
| 113232 | 6/1984 | Japan | 60/286 |

*Primary Examiner*—Douglas Hart

*Attorney, Agent, or Firm*—Sixbey, Friedman, Leedom & Ferguson

[57] ABSTRACT

A unitary system for removing particulates from the exhaust gas of an internal combustion engine includes a main flow passage and a by-pass flow passage for conducting the exhaust gas from an inlet portion to an outlet portion of a housing which contains the system. A valve for selectively directing the exhaust gas through one of the passages is provided, with a particulate trap mounted in the main flow passage for trapping particulates within the exhaust gas when the exhaust gas is directed therethrough. A regeneration system is positioned intermediate the valve and the particulate trap with an oxidation catalyst being positioned downstream of the particulate trap and in both the main flow passage and the by-pass flow passage. Further, a control system is provided for selectively activating and deactivating the regeneration system in response to predetermined operating conditions of the unitary system.

30 Claims, 2 Drawing Sheets

UNITARY HYBRID EXHAUST SYSTEM AND METHOD FOR REDUCING PARTICULATE EMMISSIONS FROM INTERNAL COMBUSTION ENGINES

TECHNICAL FIELD

This invention relates to an improved exhaust system for reducing particulate emissions from internal combustion engines and to a method of operating the same. More particularly, this invention relates to a hybrid exhaust system of a diesel engine including a particulate trap and regeneration system.

BACKGROUND OF THE INVENTION

By the year 1994, the particulate emission standards set by the Environmental Protection Agency (EPA) will require all urban buses and heavy duty trucks to emit less than 0.1 gm/hp-hr of particulate matter. Particulates are defined by EPA as any matter in the exhaust of an internal combustion engine, other than condensed water, which is capable of being collected by a standard filter after dilution with ambient air at a temperature of 125° F. Included in this definition are, agglomerated carbon particles, absorbed hydrocarbons, including known carcinogens, and sulfates.

These particulates are very small in size, with a mass median diameter of 0.5–1 micro meters, and are of very low bulk density. During the life of the typical vehicle, approximately 20 cubic feet of particulate matter which must be trapped will be emitted per 100,000 miles of engine operation. This amounts to approximately 100 lbs. of particulate matter or more depending upon the type of vehicle. Obviously this particulate matter cannot be stored within the vehicle because one pound of particulate occupies a volume of approximately 350 cubic inches. Therefore, there is a need for a filtration system which will both efficiently and reliably remove these particulates from the exhaust emission of these vehicles One such solution to the above emissions problem is disclosed in U.S. Pat. No. 4,449,362 issued to Frankenberg et al. In the disclosed system, during normal driving conditions the exhaust gas from an internal combustion engine flows through an outer passage and continues through a filter positioned at the end of the system, where a portion of the particulate matter within the exhaust is trapped and the remainder is emitted to the atmosphere. When the system senses that a sufficient amount of particulates have been collected, a portion of the exhaust gas stream is directed to flow through an inner flow passage and through an electrical heater and a catalyst bed. The catalyst bed is provided with an aspirating device which mixes fuel with the exhaust flow to raise the temperature of the catalyst bed to approximately 1200° F. This temperature is sufficient to cause the carbon particulates retained in the filter to begin burning. Upon completion of this burning cycle the exhaust is again routed through the outer passage. It should be noted, that the excess exhaust flow during the burning cycle is vented directly to the atmosphere. By positioning the catalyst bed between the filter to be regenerated and the fuel supply, the catalyst bed is directly subjected to the aspirated fuel as well as extremely high temperatures. This can result in inhibiting formations of sulfates as well as the possible burn out of the catalyst which will lead to expensive repair or require replacement of the entire system.

In U.S. Pat. No. 4,485,621 issued to Wong et al a similar system for reducing particulate emissions from internal combustion engines is disclosed. Again, a catalyst is positioned upstream of a particulate trap and directly subjected to aspirated fuel. This fuel is combined with a portion of the exhaust and expended through the catalyst and raised to a temperature of 600° C. This heated mixture is then directed through the particulate trap in order to oxidize the particulate matter retained therein. Again, by subjecting the catalyst to the aspirated fuel as well as the high temperatures, unwanted sulfates may form thereon resulting as well as possible burn out of the catalyst.

A further attempt in capturing emitted particulates within a particulate trap and system for regenerating the particulate trap is disclosed in U.S. Pat. No. 4,677,823 issued to Hardy. This system includes a particulate trap positioned within an exhaust stream, downstream of a diesel fuel burner used for the purpose of regenerating the particulate trap. During normal operation engine exhaust is routed through the particulate trap to a muffler located downstream thereof, and then expended to the atmosphere. Once a sufficient pressure build up is sensed by the control system, the regeneration cycle will commense. At this time the exhaust gas is directed through the by-pass conduit, through the muffler and expelled to the atmosphere. Diesel fuel is aspirated within the diesel fuel burner to form a fuel-air mixture which is ignited by a spark plug in response to the condition sensed by the control system. The burning mixture is maintained at a temperature between 1200° F. and 1400° F. so as to properly oxidize the particles retained in the trap. This mixture, as well as the particles dislodge from the trap and not sufficiently oxidized, are then also expelled to the atmosphere In doing so, these particles along with the exhaust gas expelled during the regeneration cycle are emitted directly into the atmosphere Without any further treatment. These untreated emissions may result in detectable particulates in excess of the new EPA standard which will be unsatisfactory for use in specified vehicles by the year 1994.

As is clear from the above, there is a pressing need for an exhaust particulate trap and regeneration system which will both significantly and reliably reduce the amount of emitted particulate from diesel engine exhaust so as to comply with the future standards set by the EPA.

SUMMARY OF THE INVENTION

In view of the foregoing, an object of the present invention is to provide an exhaust system which will significantly reduce particulate emissions from internal combustion engines in a reliable manner for extended periods of operation.

A further object of the present invention is to provide an exhaust system which minimizes the sulfates which may form on an oxidation catalyst by shielding the catalyst from excessive temperatures encountered by the system during regeneration of the particulate trap.

Another object of the present invention is to provide for at least partial treatment of the exhaust emission during the regeneration cycle.

Another object of the present invention is to reduce the impact of engine emissions deterioration by oxidizing the unburned fuel and lubricant emitted from the engine.

Yet another object of the present invention is to house the emission treatment system in a single compact unit for easy installation within existing vehicles as well as requiring small space reservations in new vehicles.

A further object of the present invention is to provide a reliable means for sensing the completion of the regeneration process thereby minimizing fuel consumption of the burner and amount of bypassed emissions.

The above objects are achieved in accordance with a preferred embodiment of the invention by providing a unitary system for removing particulates from the exhaust gas of an internal combustion engine including; a main flow passage and a by-pass flow passage for conducting the exhaust gas from an inlet portion to an outlet portion of the system, a valve for selectively directing the exhaust gas through one of the passages, a particulate trap for trapping particulates within the exhaust gas when the exhaust gas is directed through the main flow passage, a regeneration system positioned intermediate the valve and the particulate trap and an oxidation catalyst positioned downstream of the particulate trap and in both the main flow passage and the by-pass flow passage. Further, a control system is provided for operating the system and for detecting the completion of the regeneration cycle.

These as well as other objects of the invention will become apparent from the figures and the following description of the preferred embodiment.

DETAILED DESCRIPTION OF THE PREFERRED EMBODIMENT

Figure 1:
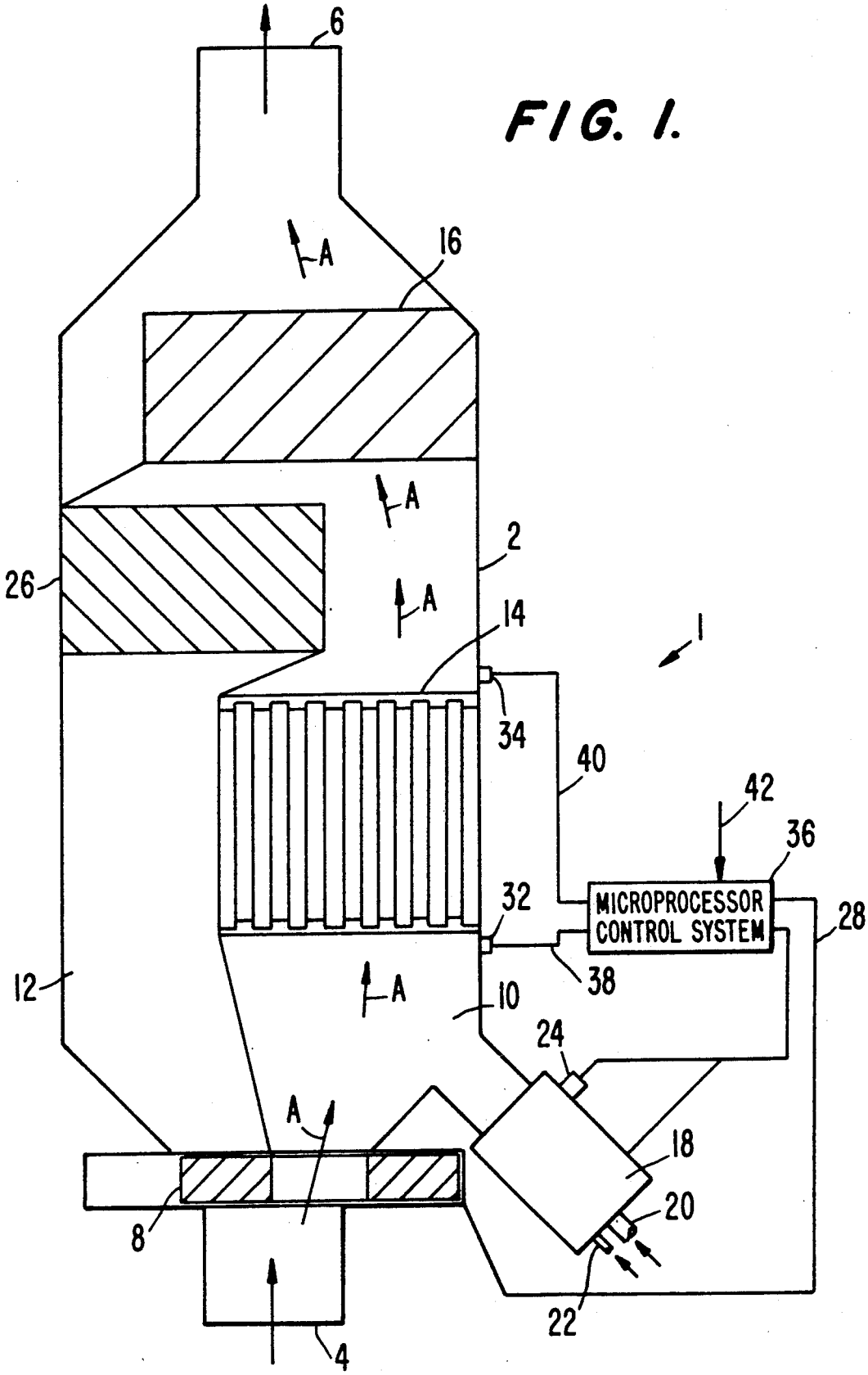
FIG. 1 is a schematic representation of the unitary hybrid particulate trap in accordance with the present invention in the normal operational trapping mode.
Figure 2:
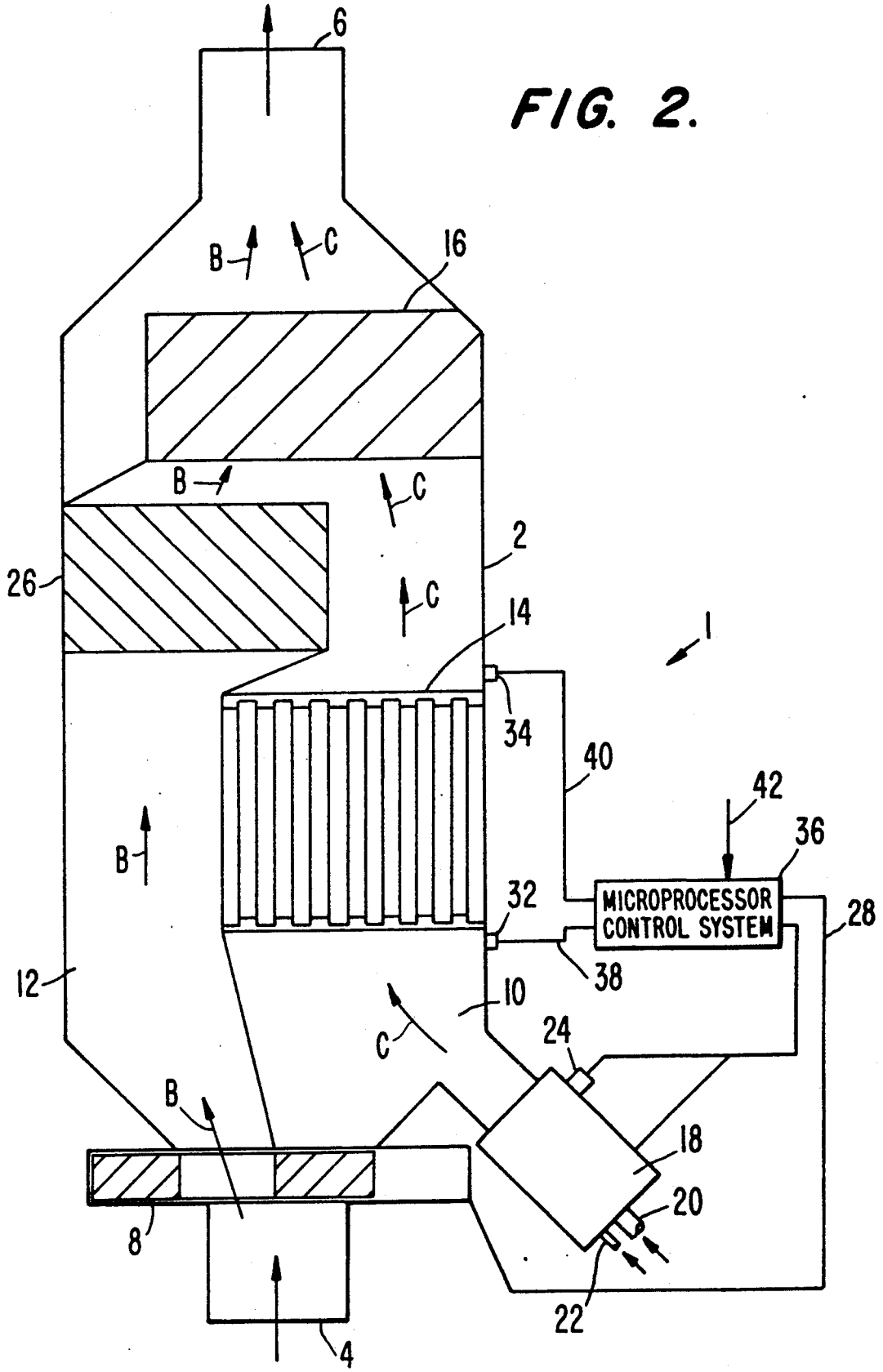
FIG. 2 is a schematic representation of the unitary hybrid particulate trap shown in FIG. 1 in its regeneration mode.

A hybrid particulate trap system 1 for reducing particulate emissions from internal combustion engines is schematically illustrated in FIGS. 1 and 2. This hybrid particulate trap system is of a unitary construction having all of its major components provided within housing 2. By providing such a unitary compact construction, this system may be easily installed within existing vehicles and readily removed therefrom for repair as well as requiring small space reservations in new vehicles.

Referring to FIG. 1, the housing 2 includes an inlet 4 and an outlet 6, thus allowing for simple placement within existing exhaust systems. Accommodated within the housing 2 is a diverter valve 8 which allows the exhaust gas emitted from the internal combustion engine (not shown) to flow through either the main flow passage 10 or the by-pass flow passage 12. Within the main flow passage 10 there is positioned a particulate trap 14 and an oxidation catalyst 16. The particular design of the particulate trap is not envisioned as part of the present invention and may be of the uncatalyzed wall flow monolith type or of the uncatalyzed ceramic foam type both of which adequately capture the carbonaceous portion of the particulate matter which flows therethrough. The oxidation catalyst 16 as illustrated in the preferred embodiment is a precious metal oxidation catalyst on a flow through metal or ceramic substrate for oxidizing unburned hydrocarbon, however, operability of the system does not depend on this particular type of oxidation catalyst.

When in the trapping mode, i.e. when the diverter valve 8 is positioned as shown in FIG. 1, exhaust from the internal combustion engine is restricted to flow through both the particulate trap 14 and the oxidation catalyst 16 located in the main passage 10, as shown by arrows A. In doing so, carbonaceous particulate matter in the engine exhaust is removed by the particulate trap as the exhaust gas passes through the medium of the trap 14. The filtered exhaust then further passes through the oxidation catalysts 16 where unburned hydrocarbons are oxidized further reducing the particulate emissions. The exhaust gas is then permitted to escape through the outlet 6 to the atmosphere.

Mounted in a position adjacent to the main flow path is a burner 18 which is periodically activated for oxidizing the particulate matter trapped in the particulate trap 14. The regeneration burner 18 is a high temperature diesel fuel burner and is located immediately upstream of the particulate trap inlet. The burner 18 may be of the type illustrated in U.S. Pat. No. 4,677,823 discussed above and includes a fuel supply 20, and air supply 22 and igniter 24 in the form of a spark plug.

Positioned within the by-pass flow passage 12, which is essentially parallel to the main flow passage 10, is a muffler 26 and the oxidation catalyst 16. When in the regeneration mode, as is shown in FIG. 2, the diverter valve 8 directs the exhaust gas flow through the by-pass flow passage 12 and subsequently through the muffler 26 and oxidation catalyst 16 prior to expelsion to the atmosphere through outlet 6, as is shown by arrows B. It should be noted at this time that the oxidation catalyst 16 is common to both the main flow passage and the by-pass flow passage. This provides for an additional 10–20 percent reduction in the particulate matter emitted to the atmosphere during the regeneration mode.

By positioning the oxidation catalyst 16 downstream of the particulate trap 14, the oxidation catalyst 16 is effectively protected from being fouled by excessive particulate matter found in the exhaust gas or ash from lubricating oil or fuel. Also the oxidation catalyst 16 is protected from the excessive heat which is generated by the regeneration burner during the regeneration mode of operation. The burner 18 when properly ignited will reach temperatures in excess of 1200° F. and often as high as 1400° F. Such excessive temperatures can damage or burn out the oxidation catalyst 16 thereby requiring its replacement.

The main flow passage is provided with a differential pressure sensor for measuring the difference in pressure across the trap. This differential pressure sensor is ported through ports 32 and 34. The differential pressure sensor supplies the microprocessor control system 36 with the pressure drop across the trap. This pressure drop is monitored continuously by the control system 36. The differential pressure drop is divided by the kinetic pressure as computed from sensors providing flow and temperature data to develop a dimensionless pressure drop (DP*). Using the same flow and temperature data as were used to non-dimensionalize the actual loaded trap pressure drop, a predicted, clean trap dimensionless pressure drop (DP*c) is computed from predetermined characteristics of the trap. The actual dimensionless pressure drop (DP*) and the ratio of the two is used as an indicator of particulate mass loading in the trap. When a specific particulate mass loading has been reached in the trap as indicated by a ratio of DP*/DP*c, the regeneration sequence shown in FIG. 2 is begun. The specific regeneration trigger ratio is based on either regeneration controllability considerations or engine exhaust flow restriction considerations which directly impact engine fuel consumption penalties. Also, the microprocessor 36 is capable of initiating the regeneration sequence upon the expiration of a predetermined amount of time interval between regeneration modes. Therefore, if the predetermined amount of time has passed since the previous regeneration cycle, the system will initiate a regeneration sequence, despite a value of the dimensionless pressure drop ratio (DP*/DP*c) below the trigger value.

When the regeneration cycle begins, exhaust gas is directed by the diverter valve 8 to flow through the by-pass flow passage 12 instead of through the main flow passage 10. The microprocessor control system 36 then activates the air and fuel supply systems and the ignition system to achieve lighting of the burner. The ignition system may be powered by a 12-volt battery (not shown) which generates a continous spark for a predetermined amount of time at the beginning of the regeneration cycle after the fuel and air supply systems have been activated. Once the burner has been ignited, hot gases are emitted from the burner which contain 11–15 percent oxygen and are directed to flow through the particulate trap 14 as shown by arrows C. In doing so, the accumulated particulate matter within the particulate trap 14 is oxidized and subsequently passed through the oxidation catalyst 16 where unburned hydrocarbons are further oxidized before the gas is permitted to enter the atmosphere.

Temperature sensors are located immediately upstream and downstream of the trap at the same locations where the differential pressure sensor ports 32, 34 are located. The trap inlet temperature sensor is used to provide data for the computation of DP* and DP*c as well as providing feedback for the control of the burner. The trap inlet temperature is used in a PID (proportional—integral—derivative) control loop in the control system software to maintain trap inlet temperature according to a specific setpoint schedule. The output of the PID control loop is a pulse width modulated (PWM) signal used to control the a burner fuel delivery device. One such burner fuel delivery device is an in-tank fuel pump (not shown) that pumps fuel from the vehicle's fuel tank into the burner fuel nozzle according to the commands of the PID control loop. Fuel pump speed, and therefore fuel flow, varies according to the percent modulation of the PWM signal from the microprocessor. Another such delivery device is a solenoid valve (not shown) for operating on a constant pressure fuel source (such as the engine fuel pump output pressure regulated to a constant and sustainable pressure). The PWM signal directly varies the percent of time that the solenoid valve is in the open position and therefore controls the fuel flow and burner output. The trap outlet temperature is also used to provide data for the computation of DP* and DP*C.

An additional critical function of the trap outlet temperature sensor is to sense the arrival of the particulate combustion or temperature wave within the regenerating particulate trap and trigger the end of the regeneration sequence. Another possible means of sensing completion of regeneration includes the continued monitoring of the (DP*/DP*C). However, the potential errors in this ratio at the low flow rates encountered during regeneration (relative to off-idle engine flow rates) make this an unreliable measure of completion of regeneration. Barring the use of sensors, another approach would be to continue the regeneration process for a fixed period of time known to be the maximum amount of time that could possibly be necessary. This, however, would be wasteful of energy and would unnecessarily degrade overall filtration efficiency in most cases. Sensing the trap outlet temperature has been found to be the most accurate and reliable means of determining the completion of regeneration cycle.

At the end of the regeneration cycle, the fuel and air supplies to the burner are shut-off and the diverter valve 8 is returned to the position shown in FIG. 1. This allows exhaust gas to again flow through the main flow passage 10 where particulate matter in the exhaust gas may again be collected in the particulate trap 14.

Various modifications to the illustrated and described hybrid exhaust system will become apparent to those of ordinary skill in the art. Accordingly, the foregoing detailed description of the preferred embodiment of the invention is to be considered exemplary in nature, and not as limiting to the scope and spirit of the invention as set forth in the appended claims.

INDUSTRIAL APPLICABILITY

The above described unitary hybrid exhaust system for reducing particulate emission may be provided in the exhaust stream of any internal combustion device. Examples of such may be boilers, furnaces, internal combustion engines and particularly diesel engines, where it is favorable to remove particulate matter found in the exhaust gases prior to their emission to the atmosphere. The system, being of a compact and unitary nature, may be easily installed within existing exhaust gas lines as well as newly manufactured internal combustion devices.

What is claimed is:

1. A system for removing particulate matter from exhaust gas of an internal combustion engine, said system comprising:

a) a main flow passage and a by-pass flow passage for conducting said exhaust gas from an inlet portion to an outlet portion of said system;

b) valve means for selectively directing said exhaust gas through one of said passages;

c) filtering means for filtering said exhaust gas directed through said main flow passage;

d) regeneration means positioned intermediate said valve means and said filtering means for selectively regenerating said filtering means by removing said particulate matter therefrom;

e) an oxidation means positioned downstream of said filtering means in said main flow passage for further oxidizing said particulate matter; and f) a control means for controlling the flow of said exhaust gas, selectively activating said regeneration means upon sensing of a predetermined condition, and deactivating said regeneration means when the regenerating of said filtering means has been completed;

wherein said system is a unitary system with said flow passages, said valve means, said filtering means, said regeneration means and said oxidation means are positions within a single housing including said inlet portion and said outlet portion.

2. The system as defined in claim 1, wherein said oxidation means is positioned in both said main flow passage and said by-pass flow passage.

3. The system as defined in claim 2, wherein said by-pass flow passage includes a muffler positioned intermediate said valve means and said oxidation means.

4. The system as defined in claim 1, wherein said oxidation means is a precious metal oxidation catalyst.

5. The system as defined in claim 1, wherein said filtering means is an uncatalyzed ceramic particulate trap.

6. The system as defined in claim 1, wherein said filtering means is a ceramic particulate trap including a base metal catalyst.

7. The system as defined in claim 1, wherein said regeneration means is a high, temperature diesel-fueled burner and includes an igniter for igniting said burner upon said sensed predetermined condition.

8. The system as defined in claim 7, wherein said system generally operates in a trapping mode with said exhaust gas flowing through said main flow passage and periodically in a regeneration mode with said exhaust gas flowing through said by-pass flow passage upon the sensing of said predetermined condition.

9. The system as defined in claim 8, further comprising as sensor means positioned adjacent said filtering means within said main flow passage for sensing said predetermined condition, said predetermined condition being sufficient build-up of said particulate matter within said filtering means.

10. The system as defined in claim 1, further comprising a temperature sensor for sensing the outlet temperature of the exhaust gas flowing through said filtering means such that said control means will deactivate said regeneration means upon the sensing of a predetermined temperature.

11. The system as defined in claim 7, wherein said igniter is a spark plug.

12. A unitary system for removing particulate matter from exhaust gas of an internal combustion engine comprising;

a housing having an inlet portion and an outlet portion;

a main flow passage and a by-pass flow passage extending from said inlet portion to said outlet portion for conducting said exhaust gas through said housing;

valve means for directing said exhaust gas through one of said passages;

filtering means positioned in said main flow passage for filtering said particulate matter from said exhaust gas;

regeneration means positioned intermediate said valve means and said filtering means in said main flow passage for selectively regenerating said filtering means by removing said particulate matter therefrom;

an oxidation means positioned downstream of said filtering means within both said main flow passage and said by-pass flow passage for further oxidizing said particulate matter; and a control means for controlling the flow of said exhaust gas, selectively activating said regeneration means upon sensing of a predetermined condition and for deactivating said regeneration means upon completion of the regeneration of said filtering means.

13. The unitary system as defined in claim 12, wherein said by-pass flow passage includes a muffler positioned intermediate said valve means and said oxidation means.

14. The unitary system as defined in claim 12, wherein said filtering means is an uncatalyzed ceramic particulate trap.

15. The unitary system as defined in claim 12, wherein said regeneration means is a high temperature diesel-fueled burner and includes an igniter for igniting said burner upon said sensed predetermined condition.

16. The unitary system as defined in claim 15, wherein said system generally operates in a trapping mode with said exhaust gas flowing through said main flow passage and periodically in a regeneration mode with said exhaust gas flowing through said by-pass flow passage upon the sensing of said predetermined condition.

17. The unitary system as defined in claim 16, further comprising a sensor means positioned adjacent said filtering means within said main flow passage for sensing said predetermined condition, said predetermined condition being sufficient build-up of said particulate matter within said filtering means.

18. The system as defined in claim 12, further comprising a temperature sensor for sensing the outlet temperature of the exhaust gas flowing through said filtering means such that said control means will deactivate said regeneration means upon the sensing of a predetermined temperature.

19. A method of removing particulate matter from the exhaust gas of an internal combustion engine comprising the steps of:

a) providing a main flow passage and a by-pass flow passage within a unitary housing for conducting said exhaust gas from an inlet portion to an outlet portion of said unitary housing;

b) providing a regeneration means, a filtering means and an oxidation means within said main flow passage of said unitary housing;

c) conducting said exhaust gas initially through said filtering means to filter said particulate matter, and then through said oxidation means to further oxidize said particulate matter;

d) periodically directing said exhaust gas through said by-pass flow passage and through said oxidation means;

e) regenerating said filtering means while said exhaust gas is directed through said by-pass flow passage; and f) redirecting said exhaust gas through said main flow passage upon completion of said regenerating step.

20. The method as defined in claim 19, wherein the step of regenerating said filtering means includes directing a heated gas from said regeneration means through said filter means and said oxidation means during said regenerating step.

21. The method as defined in claim 19, wherein said step of periodically directing said exhaust gas through said by-pass flow passage is carried out upon sensing of a predetermined condition within said filtering means.

22. The method as defined in claim 21, wherein said predetermined condition is a sufficient build-up of said particulate matter within said filtering means.

23. The method as defined in claim 19, further comprising the step of sensing the outlet temperature of said exhaust gas flowing though said filtering means, and deactivating said regeneration means in response to the sensing of a predetermined temperature.

24. The method as defined in claim 20, wherein said regeneration means includes an igniter for igniting said regeneration means upon the sensing of said predetermined condition.

25. A unitary system for removing particulate matter from exhaust gas of an internal combustion engine comprising;

a housing having an inlet portion and an outlet portion;

a main flow passage and a by-pass flow passage each extending from said inlet portion to said outlet portion within said housing for conducting said exhaust gas through said housing;

valve means for directing said exhaust gas through one of said passages;

filtering means positioned in said main flow passage for filtering said particulate matter from said exhaust gas;

a sound attenuation means positioned within said housing for attenuating sound generated by combustion gases;

regeneration means positioned intermediate said valve means and said filtering means in said main flow passage for selectively regenerating said filtering means by removing said particulate matter therefrom; and a control means for selectively positioning said valve means to direct the flow of said exhaust gas through one of said main flow passage and said by-pass flow passage while prohibiting the flow of exhaust gas through the other of said main flow passage and said by-pass flow passage.

26. The unitary system as defined in claim 25, wherein said control means operates said valve in response to a predetermined condition.

27. The unitary system as defined in claim 26, wherein said system generally operates in a trapping mode with said exhaust gas flowing through said main flow passage and periodically in a regeneration mode with said exhaust gas flowing through said by-pass flow passage upon the sensing of said predetermined condition.

28. The unitary system as defined in claim 27, further comprising a sensor means positioned adjacent said filtering means within said main flow passage for sensing and predetermined condition, said predetermined condition being sufficient build-up for said particulate matter within said filtering means.

29. The unitary system as defined in claim 25, wherein said filtering means is an uncatalyzed ceramic particulate trap.

30. A system for removing particulate matter from exhaust gas of an internal combustion engine, said system comprising:

a) a main flow passage and a by-pass flow passage for conducting said exhaust gas from an inlet portion to an outlet portion of said system;

b) valve means for selectively directing said exhaust gas through one of said passages;

c) filtering means for filtering said exhaust gas directed through said main flow passage;

d) regeneration means positioned intermediate said valve means and said filtering means for selectively regenerating said filtering means by removing said particulate matter therefrom;

e) an oxidation means positioned downstream of said filtering means in both said main flow passage and said by-pass flow passage for further oxidizing said particulate matter;

f) a muffler positioned within said by-pass flow passage and intermediate said valve means and said oxidation means; and g) a control means for controlling the flow of said exhaust gas, selectively activating said regeneration means upon sensing of a predetermined condition, and deactivating said regeneration means when the regeneration process has been completed.

* * * * *